US010302055B2

(12) United States Patent
Nishizawa et al.

(10) Patent No.: US 10,302,055 B2
(45) Date of Patent: May 28, 2019

(54) GASOLINE DELIVERY PIPE

(71) Applicant: USUI CO., LTD., Sunto-gun, Shizuoka (JP)

(72) Inventors: Hiroyuki Nishizawa, Shizuoka (JP); Shuji Suzuki, Shizuoka (JP)

(73) Assignee: USUI CO., LTD., Sunto-gun, Shizuoka (JP)

( * ) Notice: Subject to any disclaimer, the term of this patent is extended or adjusted under 35 U.S.C. 154(b) by 172 days.

(21) Appl. No.: 15/513,992

(22) PCT Filed: Jul. 27, 2015

(86) PCT No.: PCT/JP2015/003751
§ 371 (c)(1),
(2) Date: Mar. 24, 2017

(87) PCT Pub. No.: WO2016/047015
PCT Pub. Date: Mar. 31, 2016

(65) Prior Publication Data

US 2017/0292484 A1 Oct. 12, 2017

(30) Foreign Application Priority Data

Sep. 26, 2014 (JP) ..... 2014-196723

(51) Int. Cl.
*F02M 55/02* (2006.01)
*F02M 55/04* (2006.01)
*F02M 69/46* (2006.01)

(52) U.S. Cl.
CPC ..... *F02M 55/025* (2013.01); *F02M 55/02* (2013.01); *F02M 55/04* (2013.01);
(Continued)

(58) Field of Classification Search
CPC ..... F02M 55/02; F02M 55/025; F02M 2200/03; F02M 2200/315;
(Continued)

(56) References Cited

U.S. PATENT DOCUMENTS 6,082,397 A * 7/2000 Casolari ..... F16L 41/025 137/561 A
6,892,704 B2 * 5/2005 Tsuchiya ..... F02M 55/025 123/456

(Continued)

FOREIGN PATENT DOCUMENTS

JP H04-252859 A 9/1992
JP 2005-508478 A 3/2005

(Continued)

OTHER PUBLICATIONS

International Search Report for PCT/JP2015/003751 dated Sep. 29, 2015.
PCT written opinion dated Sep. 29, 2015.

*Primary Examiner* — Hung Q Nguyen
*Assistant Examiner* — Mark L. Greene
(74) *Attorney, Agent, or Firm* — Yokoi & Co., U.S.A.; Toshiyuki Yokoi

(57) ABSTRACT

To improve the ability to layout delivery pipes by maintaining flexibility in a mounting position of an inlet pipe to a delivery pipe main body. A delivery pipe for gasoline comprising a flat shaped delivery pipe main body 1 provided with a pair of facing wide walls 2, 3 and a pair of facing narrow walls 4, 5 that are more narrow than the pair of wide walls 2, 3, wherein an inlet pipe 7 is disposed and connected to the narrow wall 4 of the delivery pipe main body 1, and a connecting portion 10 of the inlet pipe 7 and the narrow wall 4 is covered continuously by a reinforcing material 11
(Continued)

from the connecting portion 10 over the wide walls 2, 3, thereby reinforcing the connection portion 10.

3 Claims, 10 Drawing Sheets

(52) U.S. Cl.
CPC ..... *F02M 69/465* (2013.01); *F02M 2200/03* (2013.01); *F02M 2200/315* (2013.01); *F02M 2200/8084* (2013.01)

(58) Field of Classification Search
CPC ... F02M 2200/8084; F02M 2200/9015; F02M 55/04; F16L 13/002; F16L 13/0218; F16L 25/0009; F16L 41/025
USPC ..... 285/141.1, 288.5, 288.9, 289.2
See application file for complete search history.

(56) References Cited

U.S. PATENT DOCUMENTS

| | | | | |
|---|---|---|---|---|
| 2002/0108660 | A1* | 8/2002 | Braun | B29C 45/1642 138/30 |
| 2011/0094477 | A1* | 4/2011 | Mehring | F02M 55/005 123/468 |

FOREIGN PATENT DOCUMENTS

| | | | |
|---|---|---|---|
| JP | 2007-127062 | A | 5/2007 |
| JP | 2007-255361 | A | 10/2007 |
| JP | 4199709 | B | 12/2008 |
| JP | 4574446 | B | 11/2010 |

* cited by examiner

Related Art

Related Art

Related Art

Related Art

Related Art

GASOLINE DELIVERY PIPE

TECHNICAL FIELD

The present invention relates to a delivery pipe for gasoline provided with an inlet pipe. In particular, it relates to a connecting portion between a delivery pipe main body and the inlet pipe.

BACKGROUND ART

Conventionally, gasoline delivery pipes for supplying gasoline to a plurality of cylinders of an engine provided with a plurality of injectors are known. Such gasoline delivery pipes sequentially jet out fuel, which is supplied via underfloor piping from a gasoline tank, through the plurality of injectors into the plurality of cylinders or intake pipes of the engine to mix the fuel with air and, by burning the air-fuel mixture, generate an output of the engine.

Return-less type gasoline delivery pipes, among these delivery pipes for gasoline, do not have piping for returning excess fuel to the fuel tank. For this reason, sudden pressure reductions when the internal pressure of the gasoline delivery pipe is reduced by fuel injection from an injector to an intake pipe or a cylinder of the engine, together with pressure waves that arise due to stopping the fuel injection, generate a pressure pulsation in the inside of the gasoline delivery pipe. The pressure pulsation is propagated to the vehicle as noise, which gives an unpleasant feeling to the driver and passengers. To reduce the pressure pulsation as described above, it has been proposed to provide delivery pipes with a pressure pulsation absorbing function by configuring the wall surfaces in flat shape. In gasoline delivery pipes having this pressure pulsation absorbing function, flexible absorber faces are formed in the outer wall, such that the pressure pulsation is absorbed and reduced by bending deformation of the absorber faces under the influence of the pressure generated in association with the fuel injection, thus enabling the generation of abnormal sound due to vibration to be prevented.

Now, in a case where an inlet pipe was connected, as shown in FIGS. 6 and 7, to a wall face of the delivery pipe main body 31 of a gasoline delivery pipe capable of reducing pulsation as described above, the bending deformation of wide walls 33, 34 and narrow walls 35, 36 of the delivery pipe main body 31 lead to stress being concentrated in the vicinity of the connecting portion 38 of a narrow wall 35 with the inlet pipe 32, such that there was a possibility of delivery pipe main body 31 being damaged. For preventing such damage, the method of connecting, as shown in FIG. 9, the inlet pipe 45 to an end cap 42 provided on either end of the delivery pipe main body 41, the method of connecting, as shown in FIG. 10 and patent document 1, the inlet pipe 55 to a portion near an end cap 51, and similar methods of connecting the inlet pipe 32, 45, 55 to a portion of the delivery pipe main body 31, 41, 51 where the bending deformation of the wide walls 33, 34, 43, 53 and narrow walls 35, 36, 44, 54 is less likely to occur are known.

Patent document 1: JP H4 252859 A

DISCLOSURE OF THE INVENTION

Problems to be Solved by the Invention

If however, as described above, the position where the inlet pipe is connected to the delivery pipe main body is restricted to a portion near the end cap or the end cap, this amounts to a limitation of the attachment position of the inlet pipe, such that there is a possibility of a substantial review of the engine layout being required or, in order to achieve a desired layout, the inlet pipe has to be made longer than necessary.

Thus, the present invention is intended to solve the above problem, making it possible to improve layout characteristics through imparting a degree of freedom to the attachment position of the inlet pipe to the delivery pipe main body.

Means for Solving the Problem

In order to solve the above problem, the present invention provides a delivery pipe for gasoline comprising a delivery pipe main body having a flat shape provided with a pair of facing wide walls and a pair of facing narrow walls of narrower width than the pair of wide walls, wherein an inlet pipe is connected to a narrow wall of the delivery pipe main body, and wherein at a connecting portion of the inlet pipe and the narrow wall, a reinforcing material is disposed in covering manner continuously from the connecting portion onto the wide walls, thereby enabling a reinforcement of the connecting portion. Furthermore, through disposing the reinforcing material in covering manner continuously onto the wide walls in this way, the reinforcing material is enabled to suppress spreading of the corner portions due to the bending of the wide walls, such that generation of high stress in the vicinity of the connection portion can be suppressed.

According to a preferred development, the inlet pipe and the reinforcing material are joined to the delivery pipe main body by brazing.

According to a preferred development, the reinforcing material is disposed in covering manner continuously from the connecting portion onto a portion of the wide walls located on both sides of the connecting portion.

Effects of the Invention

Because the present invention, as described above, by covering the connecting portion of the inlet pipe and the narrow wall of the delivery pipe main body with the reinforcing material has enabled reinforcement of the connecting portion, the generation of high stress in the vicinity of the connecting portion due to fuel pressure can be suppressed, and the delivery pipe main body is hard to be damaged. Therefore, the attachment position of the inlet pipe to the delivery pipe main body is not required to be limited to the end caps or a portion close to the end caps, such that a degree of freedom can be given to the attachment position of the inlet pipe, and the layout characteristics can be improved.

MODES FOR CARRYING OUT THE INVENTION

First Embodiment

Figure 1:
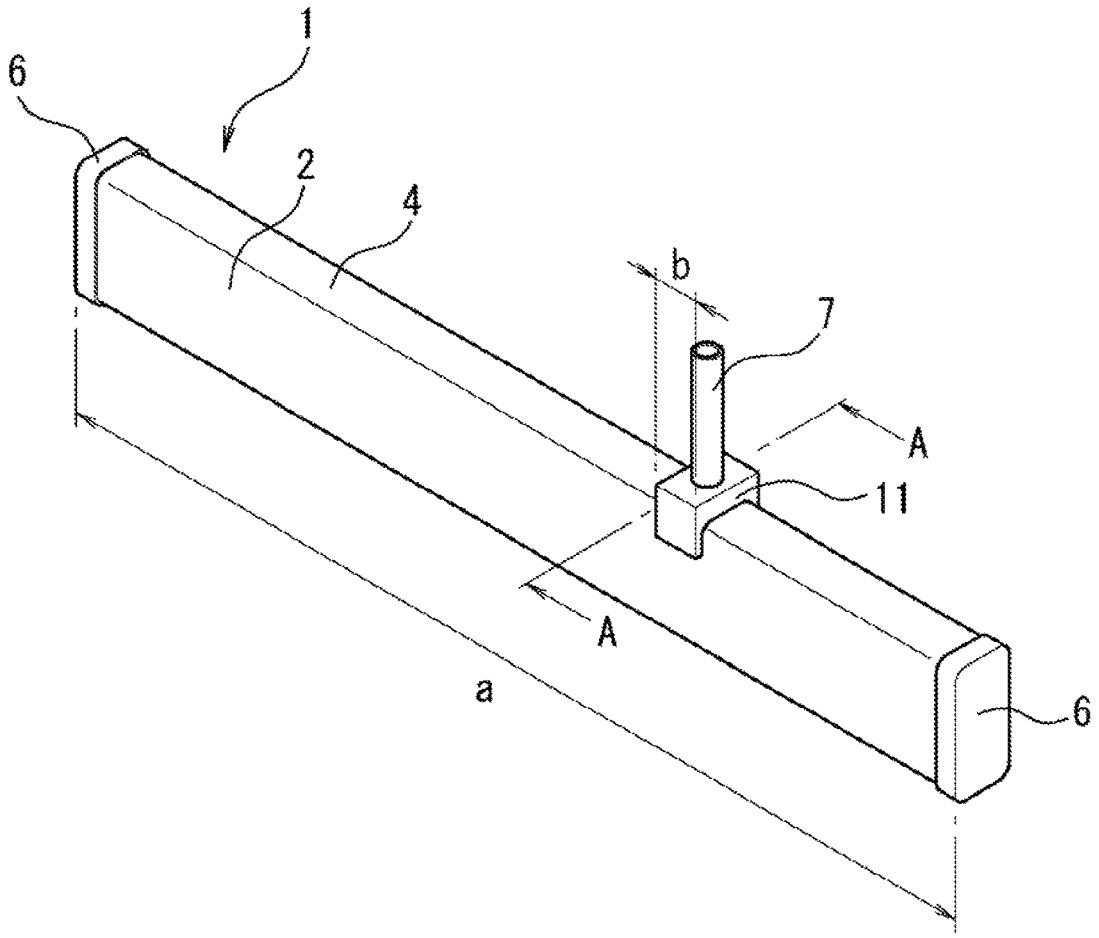
FIG. 1 is a perspective view showing a first embodiment of the present invention.

To describe a first embodiment of the present invention, a delivery pipe main body 1 is formed of a steel pipe. Furthermore, the delivery pipe main body 1 has, as in FIGS. 1 and 2, a flat shape provided with a pair of facing wide walls 2, 3 and a pair of facing narrow walls 4, 5 of narrower width than the pair of wide walls 2, 3. Respective plate-shaped end caps 6 are fixedly arranged on both ends of the delivery pipe main body 1. While in this embodiment the delivery pipe main body 1 is formed of a steel pipe, in other embodiments a SUS (Steel Use Stainless) material may be used.

In one narrow wall 4 of the delivery pipe main body 1 formed as described above, an inlet pipe 7 is connectedly arranged. That is, closer to an end cap 6 than the center in the longitudinal direction of the one narrow wall 4, a tip portion 8 of the inlet pipe 7 is arranged by insertion inwards through the narrow wall 4 of the delivery pipe main body 1 and fixed by brazing. While in the present embodiment, as described above, the inlet pipe 7 is arranged and fixed closer to an end cap 6 than centrally in the longitudinal direction of the one narrow wall 4, in other embodiments, without limitation hereto, the inlet pipe 7 may be arranged and fixed centrally in the longitudinal direction of the one narrow wall 4.

Figure 2:
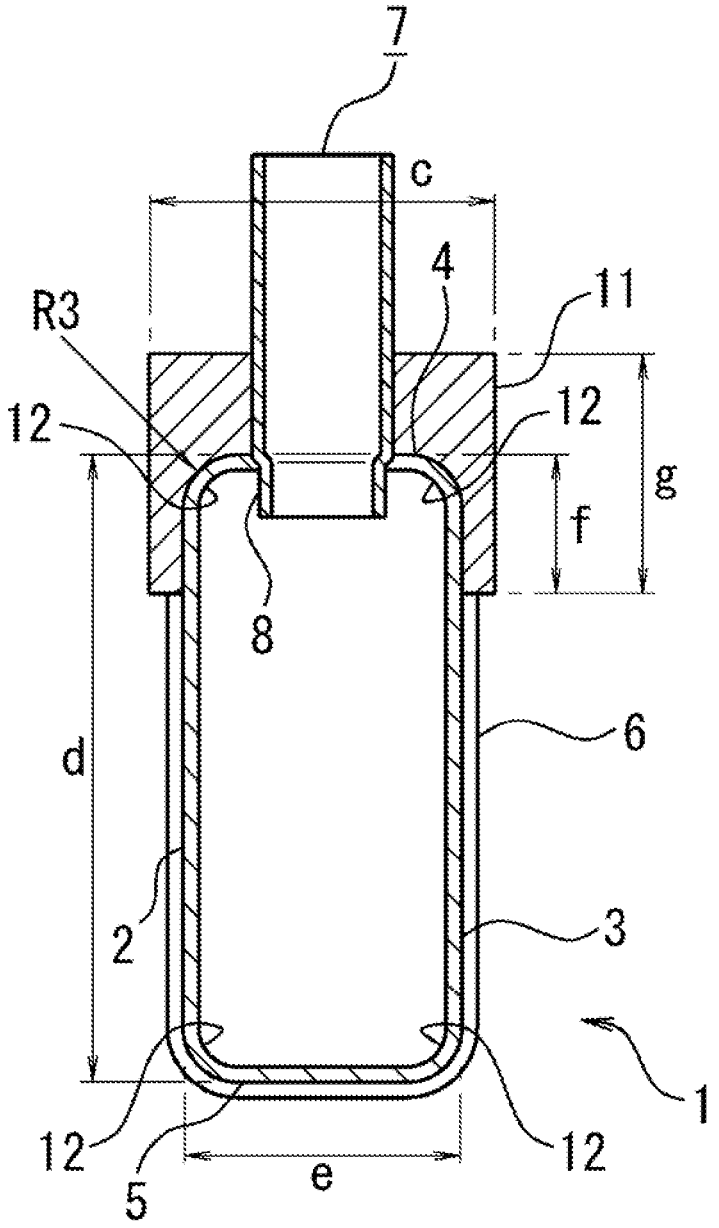
FIG. 2 is a cross-sectional view taken along line A-A of FIG. 1.
Figure 5:
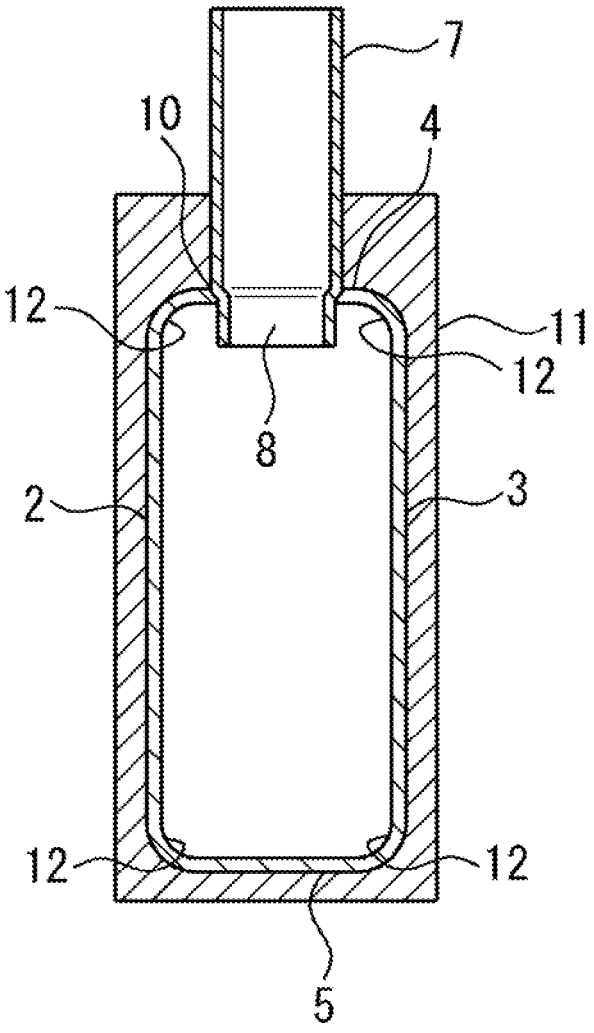
FIG. 5 is a cross-sectional view of a different embodiment.
Figure 6:
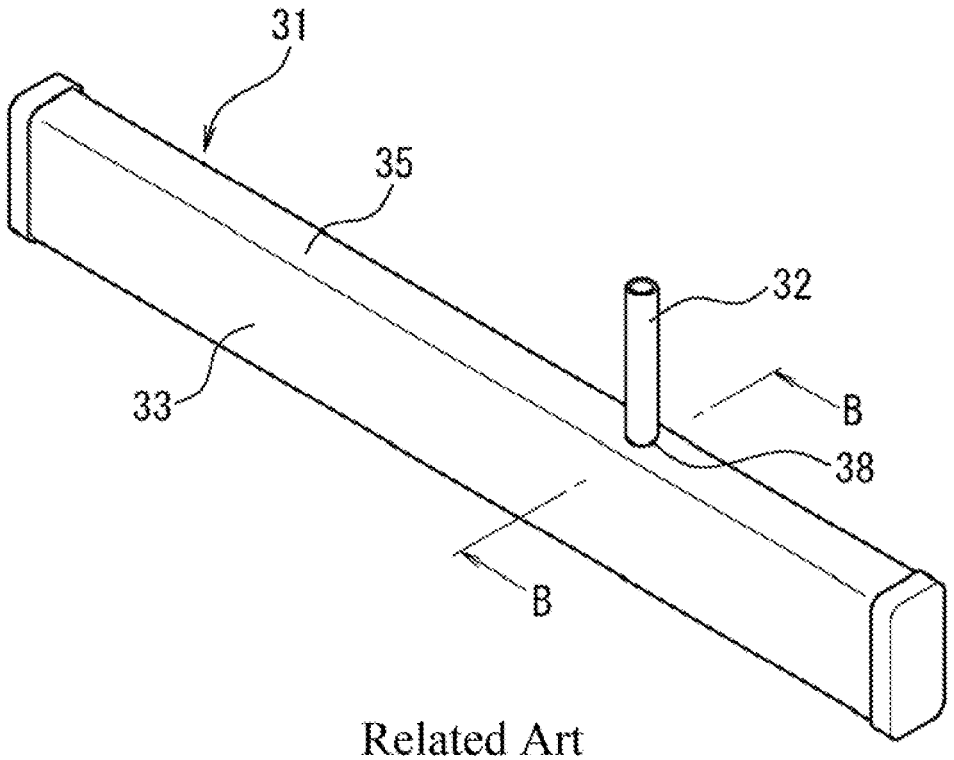
FIG. 6 is a perspective view of a first comparative example.
Figure 7:
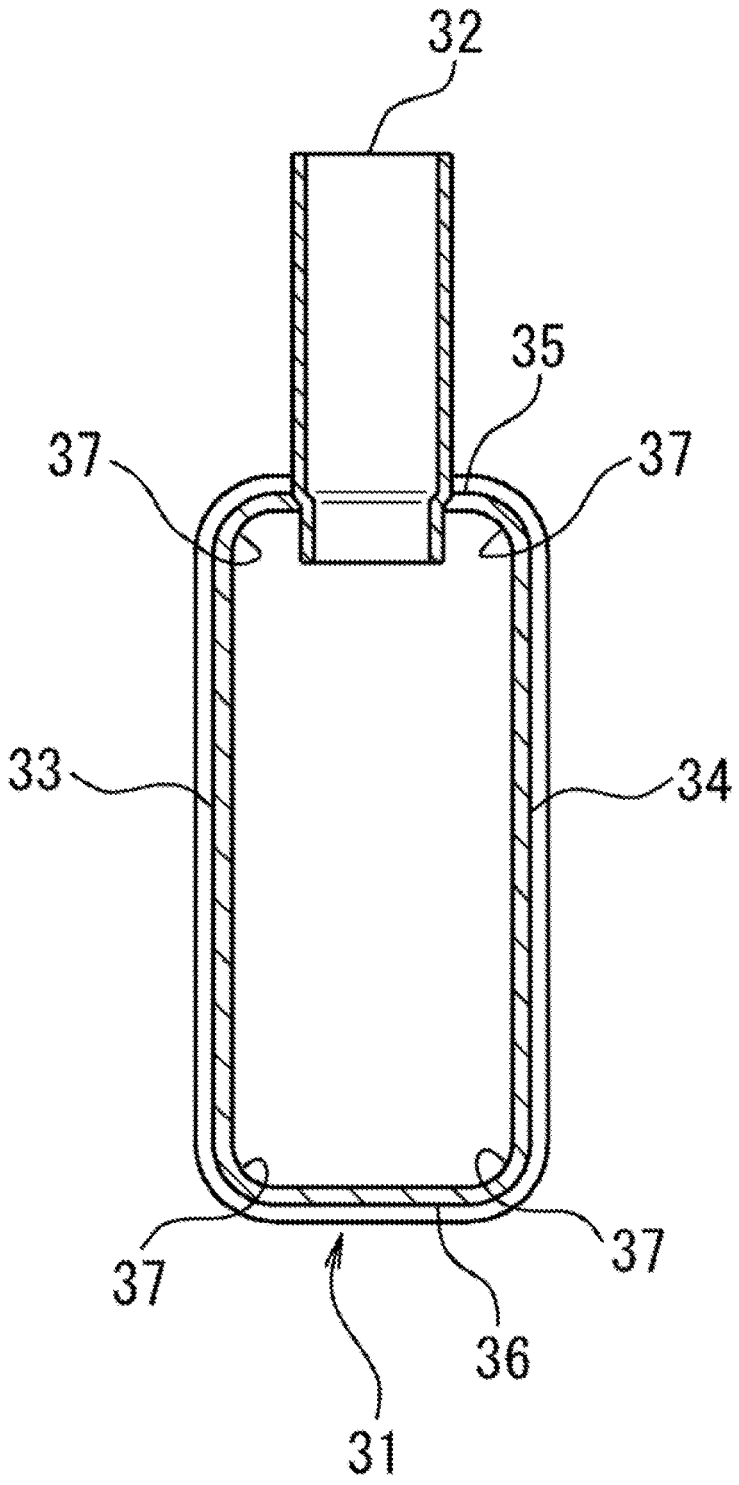
FIG. 7 is a cross-sectional view taken along line B-B of FIG. 6.

At the connecting portion 10 between the inlet pipe 7 and the delivery pipe main body 1, a reinforcing material 11 formed of carbon steel is disposed in covering fashion. That is, the reinforcing material 11 is disposed to cover the connecting portion 10 between the narrow wall 4 and the inlet pipe 7 in substantially rectangular parallelepiped shape as shown in FIG. 1, at the same time being arranged and fixed on the outer surface of the wide walls 2, 3 on both sides of the narrow wall 4, in a state of covering part of the wide walls 2, 3, as shown in FIG. 2. It is noted that while the reinforcing material 11 of the present embodiment is, as described above, arranged and fixed in a state of covering part of the wide walls 2, 3, in other embodiments, without limitation hereto, the reinforcing material 11 may be arranged and fixed, as shown in FIG. 5, over the entire circumference including the narrow wall 5 as well as the wide walls 2, 3.

Disposing the reinforcing material 11 to cover the delivery pipe main body 1 in this way, as shown in FIG. 2, results in the reinforcing material 11 being arranged over the connecting portion 10 in U-shape. Consequently, bending of the wide walls 2, 3 near the connecting portion 10 in response to fuel pressure is suppressed, which makes it possible to prevent the delivery pipe main body 1 from becoming damaged in the vicinity of the connecting portion 10. It is noted that while in this embodiment the reinforcing member 11 is formed of carbon steel, in other embodiments a SUS (Steel Use Stainless) material may be used.

Thus, in order to confirm that by providing the connection part 10 with the reinforcing member 11 damage in the vicinity of the reinforcing member 11 can be prevented, a comparison by simulation between the present embodiment and a comparative example wherein the reinforcing material 11 is not provided was carried out with regard to the influence of fuel pressure on the delivery pipe main body 1. To explain the dimensions of the present embodiment, the formation width of the delivery pipe main body 1 in axial direction is 275 mm ('a' in FIG. 1), its formation width being 36 mm ('d' in FIG. 2) and its height 16 mm ('e' in FIG. 2). The length of the reinforcing material 11 in the axial direction of the delivery pipe main body 1 is 12 mm ('b' in FIG. 1), its length in the height direction of the delivery pipe main body 1 is 20 mm ('c' in FIG. 2), its length in the width direction of the delivery pipe main body 1 is 14 mm ('g' in FIG. 2), and the length by which it overlies the wide walls 2, 3 of the delivery pipe main body 1 is 8 mm ('f' in FIG. 2).

Comparative example 1 to the present embodiment is formed by using a delivery pipe main body 31 and an inlet pipe 32 having the same shape and dimensions as those of the present embodiment. Except for the arrangement of the reinforcement material 11, each structural feature such as the inserted length of the inlet pipe 32 or the position where the inlet pipe 32 is connected to the delivery pipe main body 31 was made identical. As a result of the simulation, in a case where in comparative example 1 fuel pressure was made 800 kPa, the highest stress value in the vicinity of the connection portion 38 was 353 MPa, whereas when fuel pressure was made 800 kPa in the present embodiment, the highest stress value in the vicinity of the connection portion 10 was 254 MPa.

Figure 3:
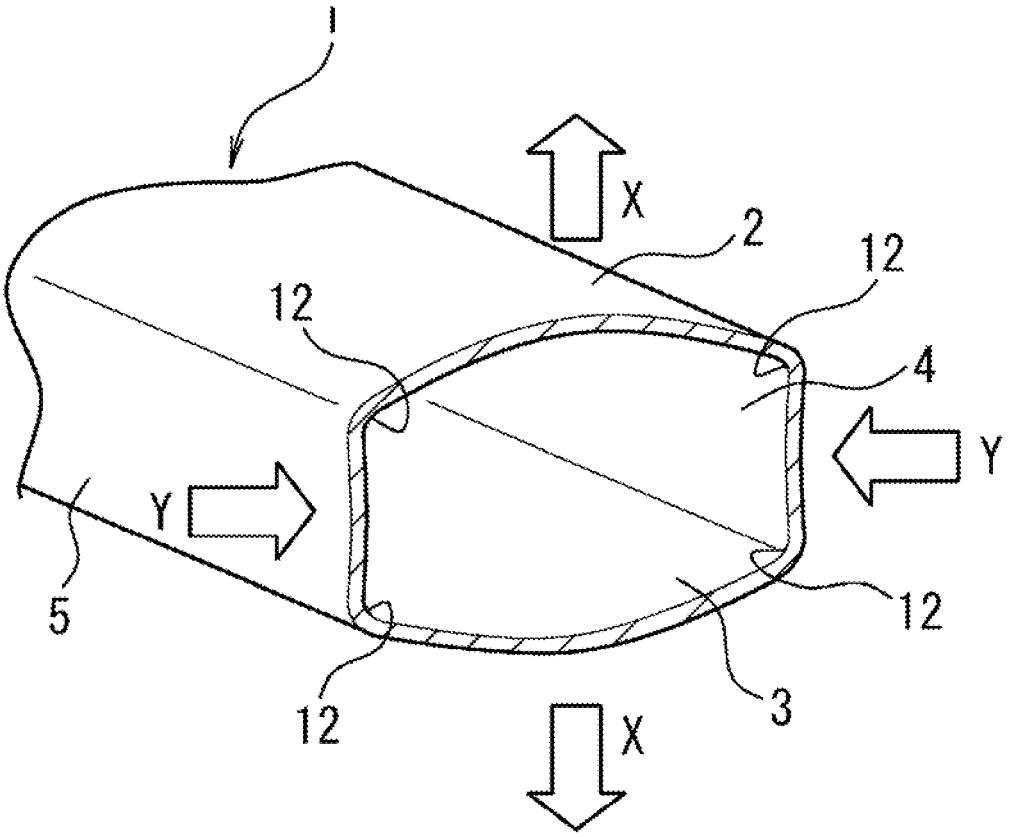
FIG. 3 is a conceptual diagram of the deformation of a delivery pipe main body due to fuel pressure.

Considering the above result, at first, when fuel pressure is applied to the delivery pipe main body 1, the delivery pipe main body 1 deforms as shown in FIG. 3. That is, while the pair of wide walls 2, 3 protrude bulging outward (arrows X in FIG. 3), the pair of narrow walls 4, 5 assume an inward-dented (arrows Y in FIG. 3) shape. When the narrow walls 4, 5 dent inward in this way, the delivery pipe main body 1 is striving to maintain the corner portions 12 formed between the wide walls 2, 3 and narrow walls 4, 5 at right angles.

Figure 8:
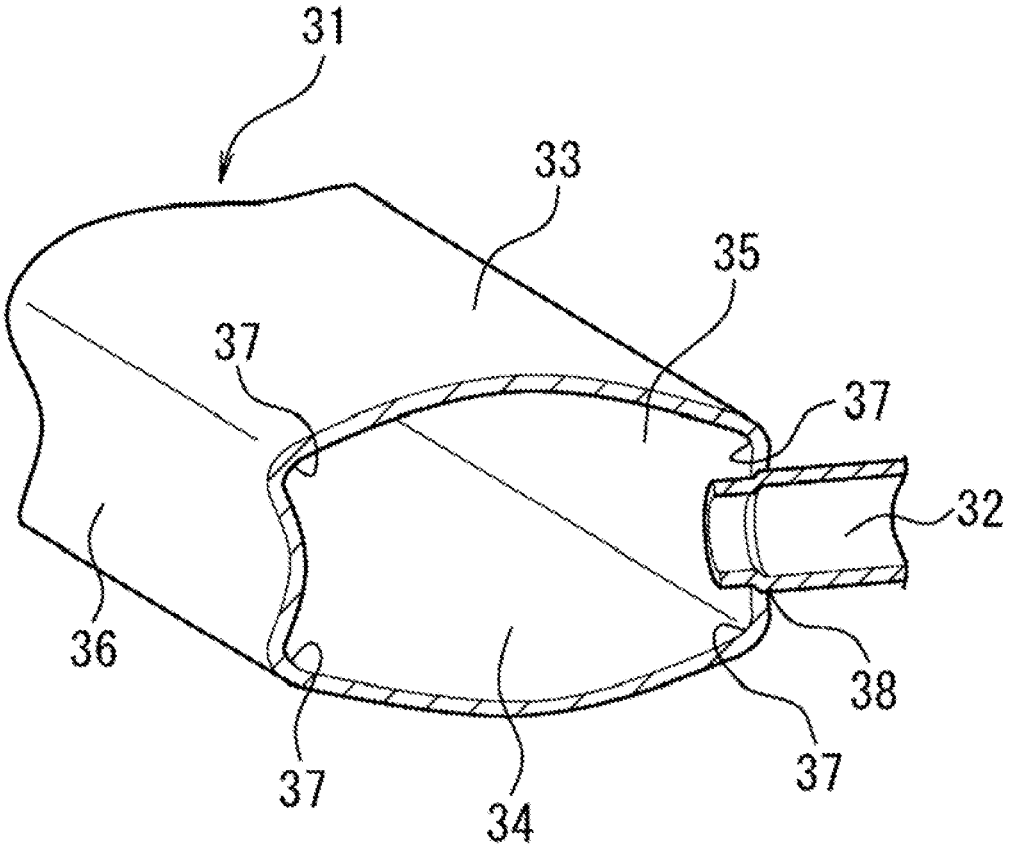
FIG. 8 is a perspective view of a cutout in the vicinity of a connection portion when fuel pressure is applied.
Figure 9:
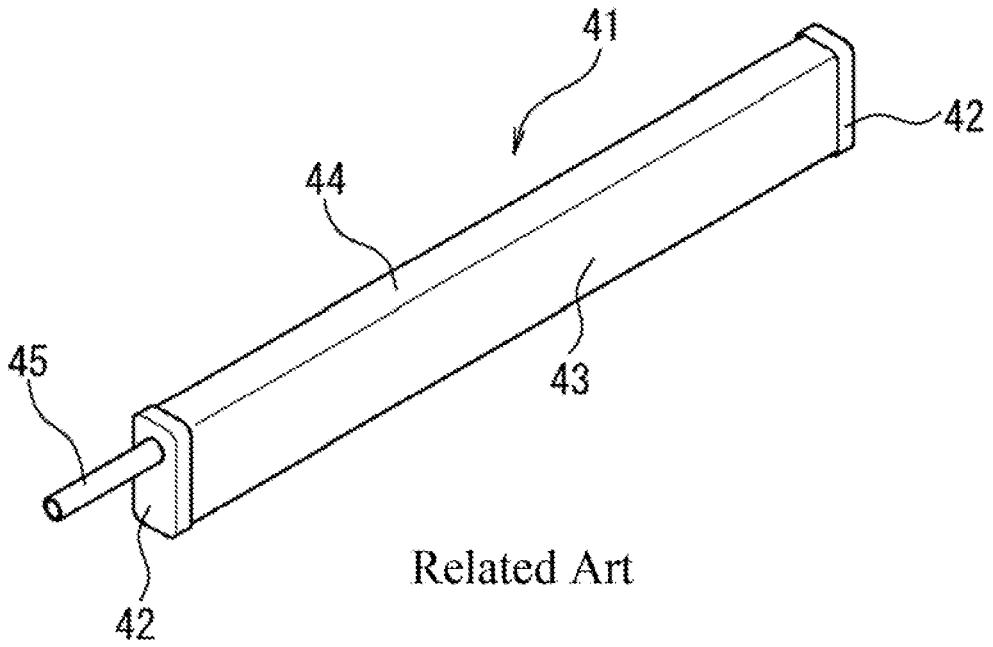
FIG. 9 is a perspective view of a conventional example in which an inlet pipe is connected to an end cap.
Figure 10:
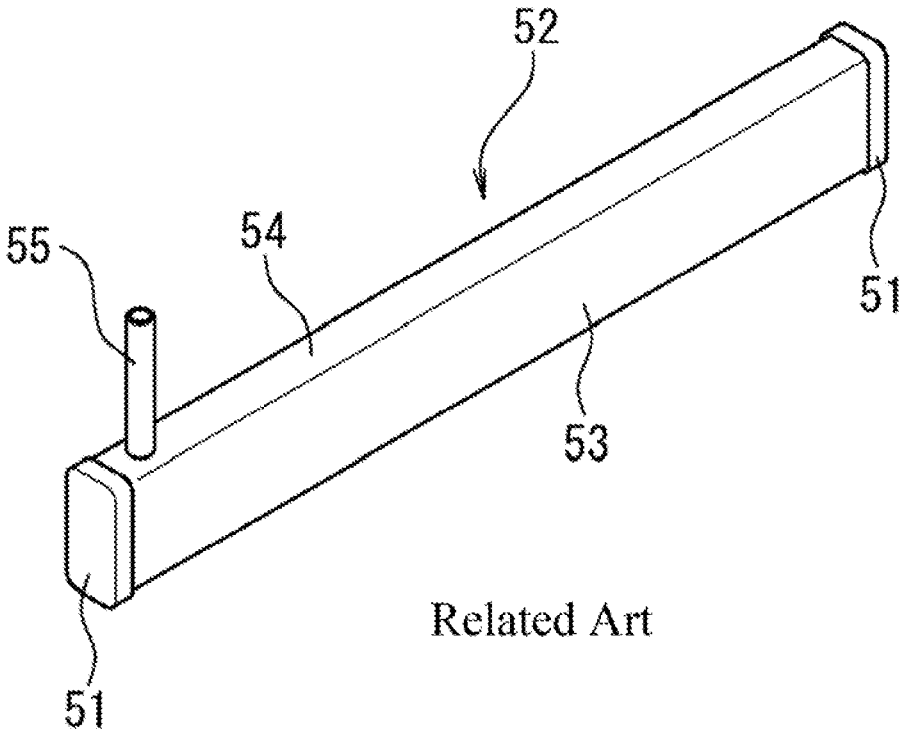
FIG. 10 is a perspective view of a conventional example in which an inlet pipe is connected to the vicinity of an end cap.

In the case of comparative example 1, as is shown in FIG. 8, in the region where the inlet pipe 32 is present it becomes difficult for the narrow wall 35 to dent inward sufficiently. Consequently, in the vicinity of the connecting portion 38 between the delivery pipe main body 31 and the inlet pipe 32 the wide walls 33, 34 bulge outward in a state where denting of the narrow wall 35 is limited, and because this leads to a widening of the angles of the corner portions 37, high stress is generated. The generation of high stress facilitates damage of the delivery pipe main body 31 in the vicinity of the connecting portion 38.

Figure 4:
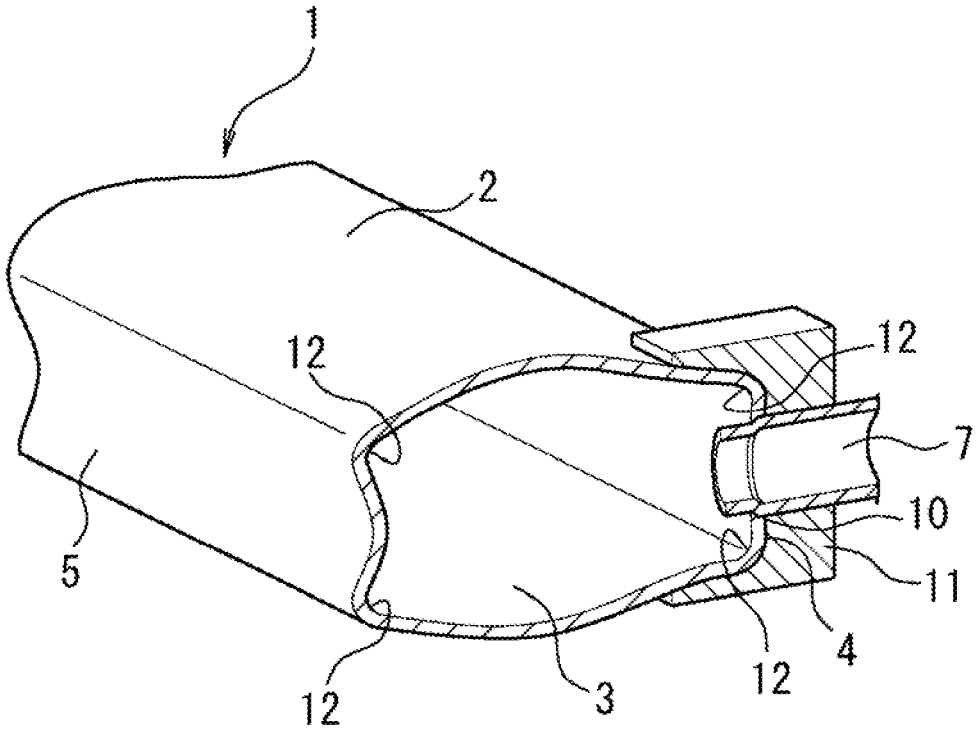
FIG. 4 is a perspective view of a cutout in the vicinity of a connection portion when fuel pressure is applied.

If on the other hand, as in the present embodiment, the reinforcement material 11 is provided at the connection portion 10 between the delivery pipe main body 1 and the inlet pipe 7, fixing the reinforcement material 11 of U-shaped cross section to the corner portions 12 formed between the wide walls 2, 3 and the narrow wall 4 where the inlet pipe 7 is connected, as shown in FIG. 4, enables the corner portions 12 to be maintained substantially at right angles even when fuel pressure rises. In the present embodiment, the provision of the reinforcement material 11 at the connection portion 10 enables the generation of high stress in the vicinity of the connection portion 10 due to fuel pressure to be suppressed, thereby making situations where the delivery pipe main body 1 is damaged hard to occur.

Accordingly, is not required to limit the attachment position of the inlet pipe 7 to the delivery pipe main body 1 to the end caps 6 or portions near the end caps 6 where high stress is inherently hard to occur. This enables to have a degree of freedom in the attachment position of the inlet pipe 7 to the delivery pipe main body 1, thus making it possible to improve layout characteristics.

DESCRIPTION OF THE REFERENCE NUMERALS

1 delivery pipe main body
2, 3 wide wall
4, 5 narrow wall
7 inlet pipe
10 connecting portion
11 reinforcing material

The invention claimed is:

1. A delivery pipe for gasoline comprising: a delivery pipe main body having a flat shape provided with a pair of facing wide walls and a pair of facing narrow walls of narrower width than the pair of facing wide walls, wherein an inlet pipe is connected to one of the facing narrow walls of the delivery pipe main body, and wherein at a connecting portion of the inlet pipe and the one of the facing narrow walls, a reinforcing material is brazed continuously from the connecting portion onto the facing wide walls to reinforce the connecting portion.

2. The delivery pipe for gasoline according to claim 1, wherein the reinforcing material is disposed in covering manner continuously from the connecting portion onto a portion of the facing wide walls located on both sides of the connecting portion.

3. The delivery pipe for gasoline according to claim 1, wherein the reinforcing material is disposed over an entire circumference of the facing narrow walls and the facing wide walls.

* * * * *